US009957586B2

(12) United States Patent
Sipilä et al.

(10) Patent No.: US 9,957,586 B2
(45) Date of Patent: May 1, 2018

(54) METHOD OF USING A SUSPENSION SMELTING FURNACE, A SUSPENSION SMELTING FURNACE, AND A CONCENTRATE BURNER

(71) Applicant: Outotec Oyj, Espoo (FI)

(72) Inventors: Jussi Sipilä, Espoo (FI); Markku Lahtinen, Espoo (FI); Peter Björklund, Espoo (FI); Kaarle Peltoniemi, Espoo (FI); Tapio Ahokainen, Helsinki (FI); Lauri P. Pesonen, Helsinki (FI); Kaj Eklund, Pori (FI)

(73) Assignee: Outotec Oyj, Espoo (FI)

( * ) Notice: Subject to any disclaimer, the term of this patent is extended or adjusted under 35 U.S.C. 154(b) by 132 days.

(21) Appl. No.: 14/666,691

(22) Filed: Mar. 24, 2015

(65) Prior Publication Data

US 2015/0197828 A1 Jul. 16, 2015

Related U.S. Application Data

(62) Division of application No. 13/502,523, filed as application No. PCT/FI2010/050811 on Oct. 19, 2010, now Pat. No. 9,034,243.

(30) Foreign Application Priority Data

Oct. 19, 2009 (FI) ..... 20096071
Dec. 11, 2009 (FI) ..... 20096315

(51) Int. Cl.
*C22B 5/14* (2006.01)
*F27B 15/10* (2006.01)
(Continued)

(52) U.S. Cl.
CPC ..... *C22B 5/14* (2013.01); *C22B 5/12* (2013.01); *C22B 15/00* (2013.01); *F27B 15/10* (2013.01);
(Continued)

(58) Field of Classification Search
CPC ... C22B 15/00; C22B 5/12; C22B 5/14; F27B 15/10; F27B 15/14; F27D 3/16; F27D 3/01
(Continued)

(56) References Cited

U.S. PATENT DOCUMENTS 2,506,557 A 5/1950 Bryk et al.
4,027,863 A 6/1977 Aaltonen et al.
(Continued)

FOREIGN PATENT DOCUMENTS

AU 2002217183 B2 7/2002
CN 1079511 12/1993
(Continued)

OTHER PUBLICATIONS

Korean Office Action issued by the Korean Intellectual Property Office for KR 2012-7009986, dated Jan. 8, 2016, 14 pages.
(Continued)

*Primary Examiner* — Jessee Roe
*Assistant Examiner* — Michael Aboagye
(74) *Attorney, Agent, or Firm* — Chernoff Vilhauer LLP

(57) ABSTRACT

The invention relates to a method of using a suspension smelting furnace and to a suspension smelting furnace and to a concentrate burner (4). The concentrate burner (4) comprises a first gas supply device (12) for feeding a first gas (5) into the reaction shaft (2) and a second gas supply device (18) for feeding a second gas (16) into the reaction shaft (2). The first gas supply device (12) comprises a first annular discharge opening (14), which which is arranged
(Continued)

concentrically with the mouth (8) of a feeder pipe (7), so that the first annular discharge opening (14) surrounds the feeder pipe (7). The second gas supply device (18) comprises a second annular discharge opening (17), which is arranged concentrically with the mouth (8) of the feeder pipe (7), so that the second annular discharge opening (17) surrounds the feeder pipe (7) opening (14).

22 Claims, 4 Drawing Sheets

(51) Int. Cl.

| | |
|---|---|
| ***F27B 15/14*** | (2006.01) |
| ***F27D 3/16*** | (2006.01) |
| ***C22B 5/12*** | (2006.01) |
| ***C22B 15/00*** | (2006.01) |
| ***F27D 3/18*** | (2006.01) |

(52) U.S. Cl.
CPC ..... *F27B 15/14* (2013.01); *F27D 3/16* (2013.01); *F27D 3/18* (2013.01)

(58) Field of Classification Search
USPC ..... 266/221, 267, 216, 44, 182, 176, 217; 75/455, 707, 454, 640, 652
See application file for complete search history.

(56) References Cited

U.S. PATENT DOCUMENTS

| | | | | |
|---|---|---|---|---|
| 4,147,535 | A | 4/1979 | Lilja et al. | |
| 4,392,885 | A | 7/1983 | Lilja et al. | |
| 5,042,964 | A | 8/1991 | Gitman | |
| 5,133,801 | A | 7/1992 | Saarinen | |
| 5,149,261 | A | 9/1992 | Suwa et al. | |
| 5,174,746 | A | 12/1992 | Kemori et al. | |
| 5,358,222 | A | 10/1994 | Kaasinen et al. | |
| 5,362,032 | A | 11/1994 | Ranki | |
| 5,443,620 | A * | 8/1995 | Kaasinen | F23C 7/00 75/629 |
| 5,542,361 | A | 8/1996 | Lilja et al. | |
| 6,238,457 | B1 | 5/2001 | Holmi | |
| 8,147,747 | B2 * | 4/2012 | Wang | C22B 13/02 110/182.5 |
| 2010/0207307 | A1 | 8/2010 | Sipila et al. | |

FOREIGN PATENT DOCUMENTS

| | | |
|---|---|---|
| CN | 1232538 | 10/1999 |
| EP | 0177090 | 4/1986 |
| EP | 0499956 A1 | 8/1992 |
| FI | 922530 | 12/1993 |
| FI | 932458 | 11/1994 |
| GB | 1569813 A | 6/1980 |
| JP | 248832/1985 | 12/1985 |
| JP | 142446/1989 | 9/1989 |
| JP | H0770659 | 3/1995 |
| JP | 2002060858 | 2/2002 |
| JP | 2003129146 | 5/2003 |
| WO | 2009/030808 A1 | 3/2009 |

OTHER PUBLICATIONS

Finnish Search report for Finnish priority application No. 20096315, dated Sep. 24, 2010, 4 pgs.
International Search report for related International application No. PCT/FI2010/050811, dated Feb. 11, 2011.
International Preliminary Report on Patentability with Article 34 amendments for related International application No. PCT/FI2010/050811, dated Oct. 13, 2011, 28 pgs.
Chinese Office Action dated Dec. 4, 2013, to include Chinese search report dated Nov. 26, 2013 for Chinese Application No. 201010621675.X (with English translation), 23 pages.
Eurasian Office Action for application No. 201290162/31, dated Apr. 14, 2014, 5 pgs.
Office Action from corresponding Japanese patent application No. 2012-534732, dated Nov. 26, 2014, with English translation, 8 pgs.
Brazilian Office Action issued by the Brazilian Patent and Trademark Office for BR 112012009203-0, dated Jul. 31, 2017, 12 pages.

* cited by examiner

METHOD OF USING A SUSPENSION SMELTING FURNACE, A SUSPENSION SMELTING FURNACE, AND A CONCENTRATE BURNER

This application is a division of U.S. patent application Ser. No. 13/502,523, filed Apr. 17, 2012, now U.S. Pat. No. 9,034,243 issued May 19, 2015, which is a national stage application filed under 35 USC 371 based on International Application No. PCT/FI2010/050811 filed Oct. 19, 2010 and claims priority under 35 USC 119 of Finnish Patent Application No. 20096071 filed Oct. 19, 2009 and of Finnish Patent Application No. 20096315 filed Dec. 11, 2009.

BACKGROUND OF THE INVENTION

The object of the invention is the method of using a suspension smelting furnace.

Another object of the invention is the suspension smelting furnace.

Another object of the invention is the concentrate burner.

The invention also relates to various uses of the method, the suspension smelting furnace, and the concentrate burner for solving process problems of different types of the suspension smelting furnace and/or improving the process effectiveness.

The invention relates to the method that takes place in the suspension smelting furnace, such as a flash smelting furnace, and to the suspension smelting furnace, such as the flash smelting furnace.

The flash smelting furnace comprises three main parts: a reaction shaft, a lower furnace and a raised shaft. In the flash smelting process, a powdery solid matter, which comprises a sulphidic concentrate, a slag forming agent and other powdery components, is mixed with reaction gas by means of a concentrate burner in the upper part of the reaction shaft. The reaction gas can be air, oxygen or oxygen-enriched air. The concentrate burner comprises a feeder pipe for feeding the fine-grained solid matter into the reaction shaft, where the mouth of the feeder pipe opens in the reaction shaft. The concentrate burner further comprises a diffusion device, which is arranged concentrically inside the feeder pipe and which extends to a distance from the mouth of the feeder pipe inside the reaction shaft, and which comprises diffusion gas holes for directing a diffusion gas to the fine solid matter that flows around the diffusion device. The concentrate burner further comprises a gas supply device for feeding the reaction gas into the reaction shaft, the gas supply device opening in the reaction shaft through an annular discharge opening that surrounds the feeder pipe concentrically for mixing the reaction gas that discharges from the said annular discharge opening with the fine solid matter, which discharges from the feeder pipe in the middle and which is directed sidewards by means of the diffusion gas.

The flash smelting method comprises a stage at which, into the reaction shaft, fine solid matter is fed into the reaction shaft through the mouth of the feeder pipe of the concentrate burner. The flash smelting method further comprises a stage, at which diffusion gas is fed into the reaction shaft through the diffusion gas holes of the diffusion device of the concentrate burner for directing the diffusion gas to the fine solid matter that flows around the diffusion device, and a stage, at which the reaction gas is fed into the reaction shaft through the annular discharge opening of the gas supply device of the concentrate burner for mixing the reaction gas with the fine solid matter, which discharges from the feeder pipe in the middle and which is directed sidewards by means of the diffusion gas.

In most cases, the energy needed for the smelting is obtained from the mixture itself, when the components of the mixture, which are fed into the reaction shaft, the powdery solid matter and the reaction gas, react with each other. However, there are raw materials which, when reacting with each other, do not produce enough energy and the sufficient smelting of which requires that a fuel gas is also fed into the reaction shaft to produce energy for the smelting.

Publication U.S. Pat. No. 5,362,032 presents a concentrate burner.

SHORT DESCRIPTION OF THE INVENTION

The object of the invention is to provide a method of using the suspension smelting furnace, a suspension smelting furnace, and a concentrate burner which can be used for solving various problems of suspension smelting processes, such as flash smelting processes and/or which can be used for enhancing the suspension smelting process, such as the flash smelting process.

The object of the invention is achieved by the method of using the suspension smelting furnace according to the independent Claim 1.

Preferred embodiments of the method according to the invention are disclosed in the dependent Claims 2-16.

Another object of the invention is the suspension smelting furnace according to the independent Claim 17.

Preferred embodiments of the suspension smelting furnace according to the invention are disclosed in the dependent Claims 18-30.

Another object of the invention is the concentrate burner to the independent Claim 31.

Preferred embodiments of the concentrate burner according to the invention are disclosed in the dependent Claims 32-44.

The object of the invention also comprises the uses of the method, the suspension smelting furnace, and the concentrate burner disclosed in Claims 45-51.

The method of using the suspension smelting furnace according to the invention is based on the fact that the method employs a concentrate burner, which comprises a first gas supply device for feeding a first gas into the reaction shaft of the suspension smelting shaft, and a second gas supply device for feeding a second gas into the reaction shaft of the suspension smelting furnace, whereby the first gas supply device comprises a first annular discharge opening, which opens in the reaction shaft of the suspension smelting furnace and which is arranged concentrically with the mouth of the feeder pipe, so that the first annular discharge opening surrounds the feeder pipe, and whereby the second gas supply device comprises a second annular discharge opening, which opens in the reaction shaft of the suspension smelting furnace and which is arranged concentrically with the mouth of the feeder pipe, so that the second annular discharge opening surrounds the feeder pipe.

Correspondingly, the suspension smelting furnace according to the invention comprises a concentrate burner, which comprises a first gas supply device for feeding first gas into the reaction shaft of the suspension smelting shaft, and a second gas supply device for feeding second gas into the reaction shaft of the suspension smelting furnace, whereby the first gas supply device comprises a first annular discharge opening, which opens in the reaction shaft of the suspension smelting furnace and which is arranged concentrically with the mouth of the feeder pipe, so that the first annular discharge opening surrounds the feeder pipe, and whereby the second gas supply device comprises a second annular discharge opening, which opens in the reaction shaft of the suspension smelting furnace and which is arranged concentrically with the mouth of the feeder pipe, so that the second annular discharge opening surrounds the feeder pipe.

Since the solution according to the invention employs the concentrate burner, which comprises the above-mentioned first gas supply device for feeding first gas into the reaction shaft of the suspension smelting furnace, and the above-mentioned second gas supply device for feeding second gas into the reaction shaft of the suspension smelting furnace, it is possible, in the method according to the invention, to use one and the same concentrate burner for feeding different gases in different spots of the concentrate burner and to also mix various substances, fluids and/or fluid mixtures to gases to solve process problems of different types and/or to enhance the suspension smelting activity of the suspension smelting furnace. Additionally or alternatively, it becomes possible to control the flows of first gas and second gas, such as the flow velocity, flow pattern and/or the rate of flow independently of each other.

LIST OF FIGURES

In the following, preferred embodiments of the invention are presented in detail with reference to the appended drawings, wherein FIG. 1 shows one preferred embodiment of the suspension smelting furnace according to the invention;

Figure 5:
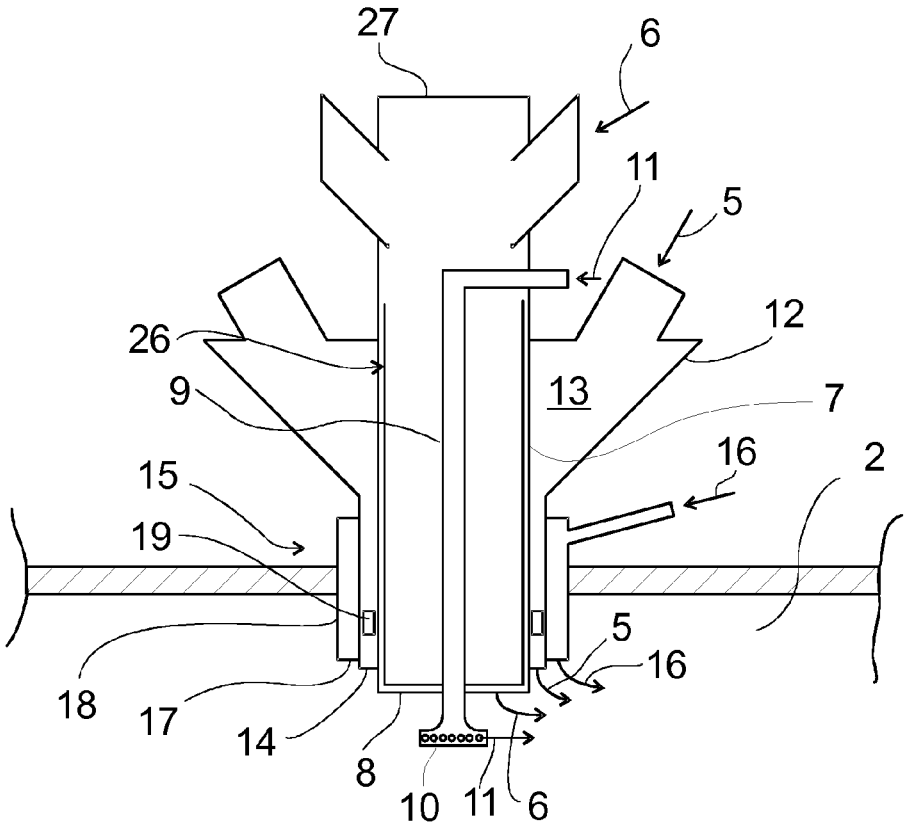
Figure 6:
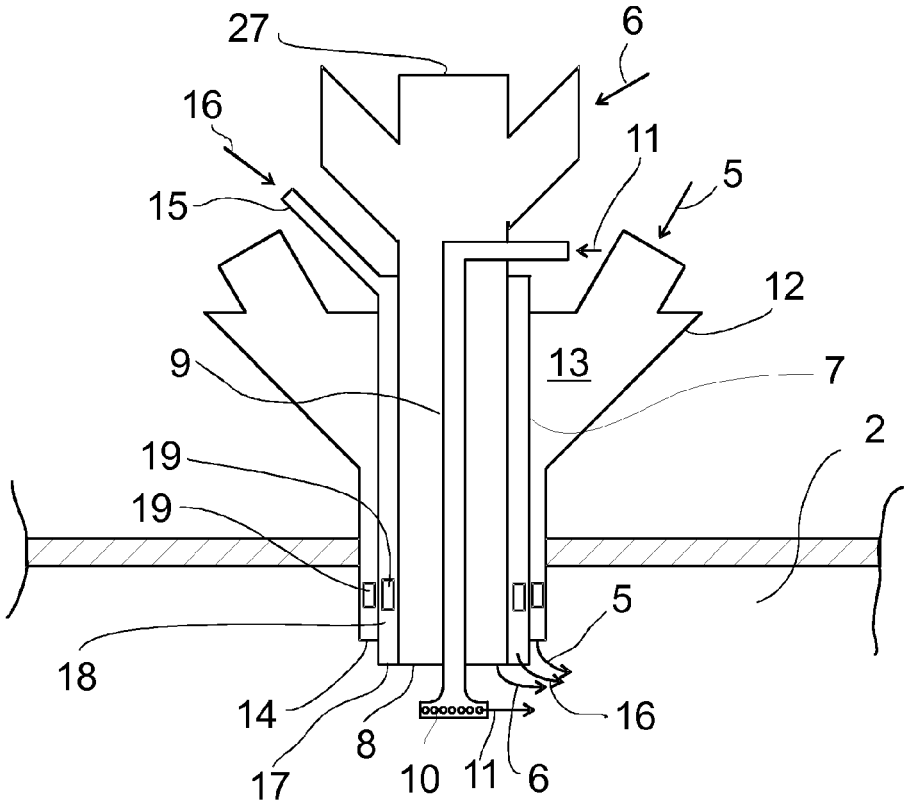
Figure 7:
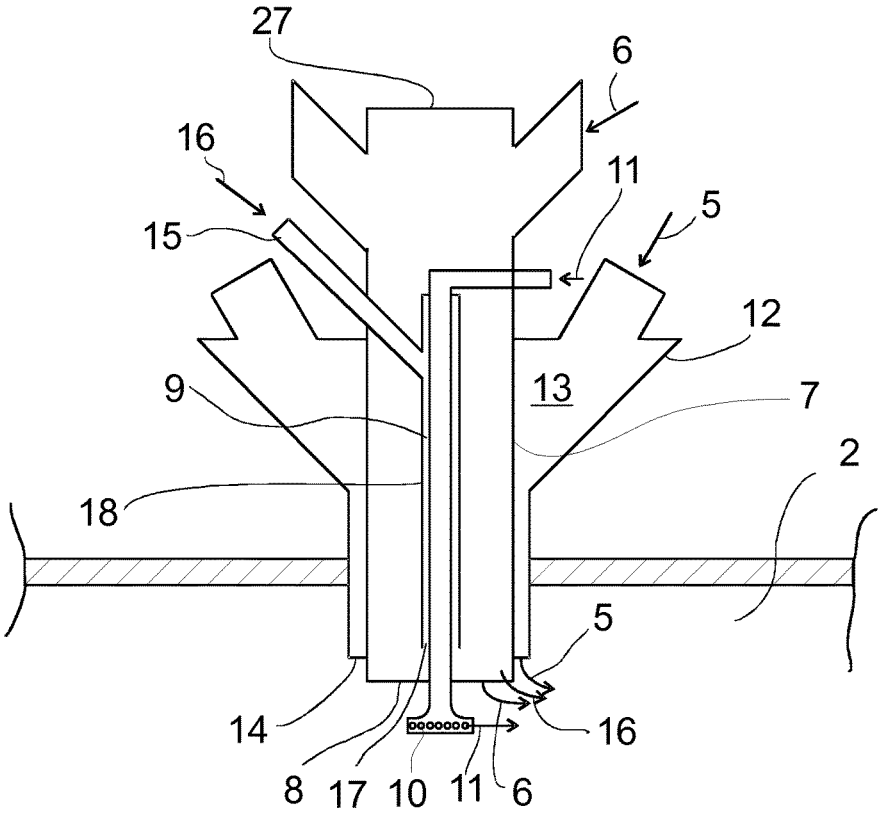
Figure 8:
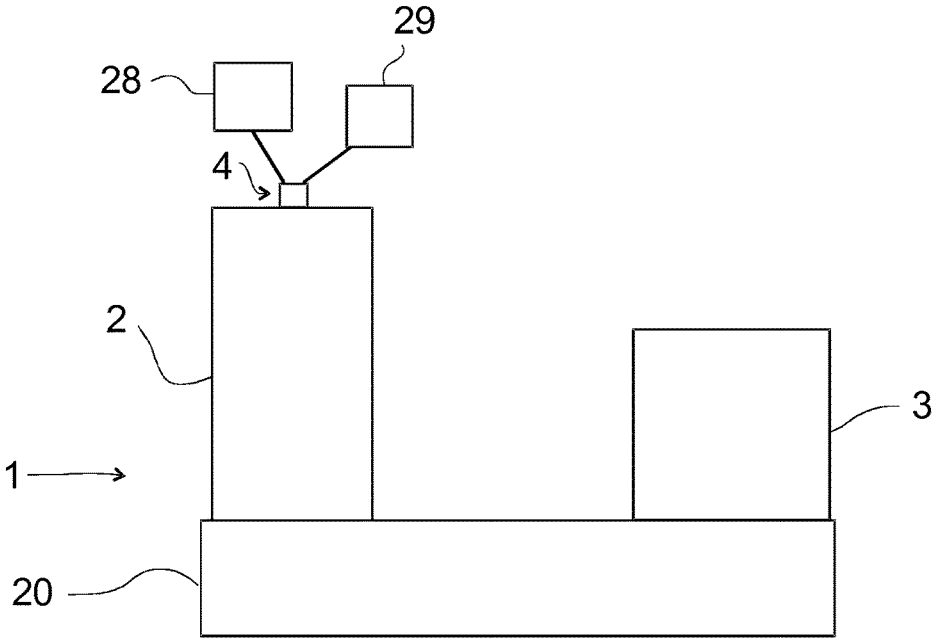

FIG. 5 shows a fourth concentrate burner, which can be used in the fifth embodiment of the method and the suspension smelting furnace according to the invention, FIG. 6 shows a fifth concentrate burner, which can be used in the fifth embodiment of the method and the suspension smelting furnace according to the invention, FIG. 7 shows a sixth concentrate burner, which can be used in the fifth embodiment of the method and the suspension smelting furnace according to the invention, and FIG. 8 shows a second preferred embodiment of the suspension smelting furnace according to the invention.

DETAILED DESCRIPTION OF THE INVENTION

Firstly, the object of the invention is the method of using the suspension smelting furnace 1.

Figure 1:
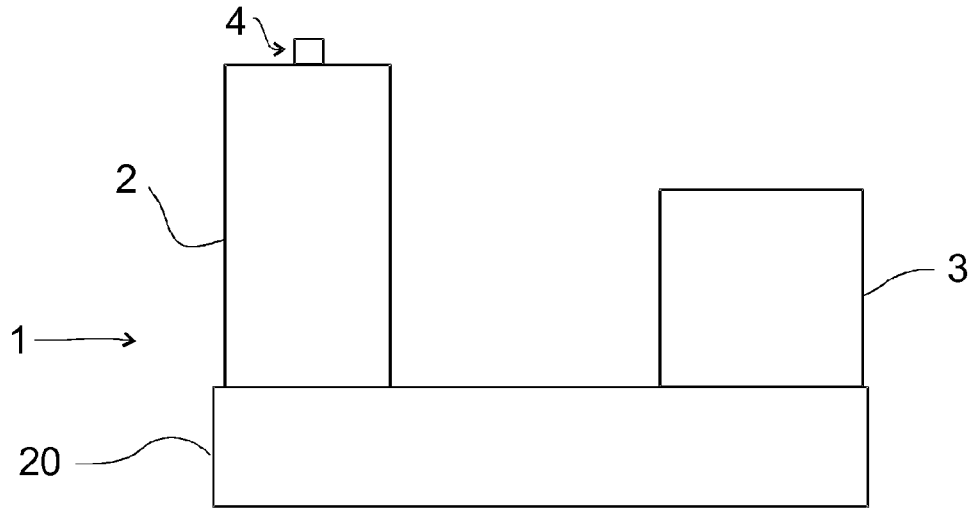
Figure 2:
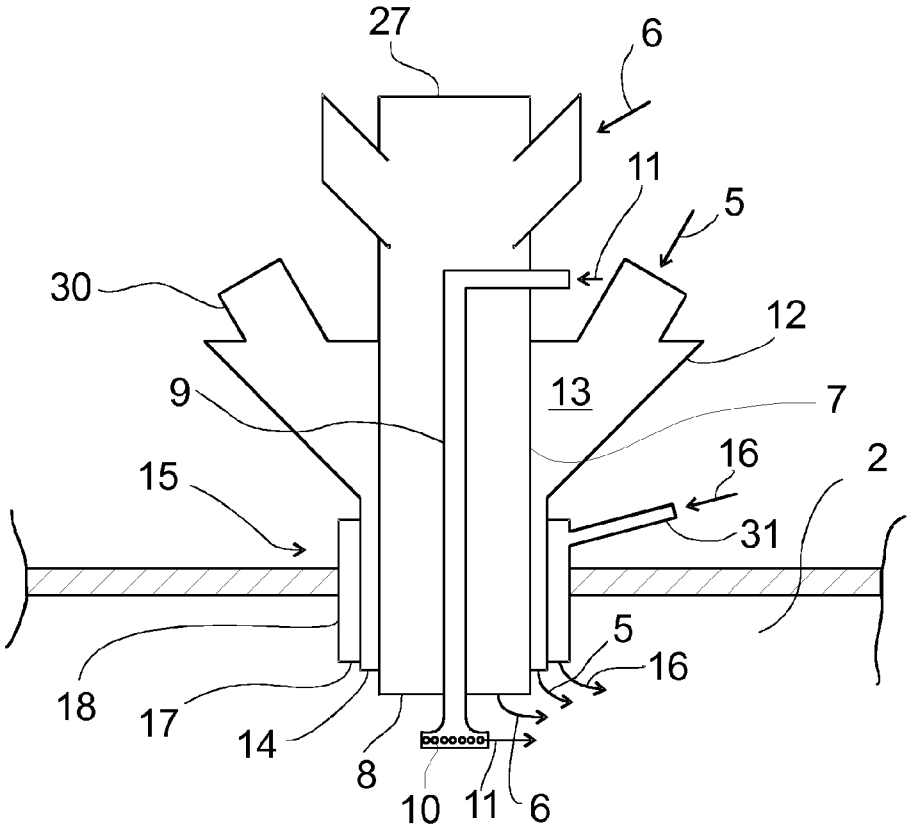
FIG. 2 shows the concentrate burner, which can be used in the suspension smelting furnace according to the invention.

The suspension smelting furnace 1 shown in FIG. 1 comprises a reaction shaft 2, a raised shaft 3 and a lower furnace 20.

The method employs the concentrate burner 4, which comprises a fine solid matter supply device 27 which comprises a feeder pipe 7 for feeding fine-grained solid matter 6 into the reaction shaft 2, where the mouth 8 of the feeder pipe opens in the reaction shaft 2. The fine solid matter can comprise, e.g., a nickel or copper concentrate, a slag formation agent and/or fly ash.

The method employs the concentrate burner 4, which further comprises a diffusion device 9, which is arranged concentrically inside the feeder pipe 7 and which extends to a distance from the mouth 8 of the feeder pipe inside the reaction shaft 2. The diffusion device 9 comprises diffusion gas openings 10 for directing a diffusion gas 11 around the diffusion device 9 to fine solid matter 6 that flows around the diffusion device 9.

The method employs the concentrate burner 4, which further comprises a first gas supply device 12 for feeding first gas 5 into the reaction shaft 2. The first gas supply device 12 opens in the reaction shaft 2 through the first annular discharge opening 14, which surrounds the feeder pipe 7 concentrically, for mixing first gas 5 that discharges from the said first annular discharge opening 14 with fine solid matter 6, which discharges from the feeder pipe 7 in the middle and which is directed sidewards by means of diffusion gas 11.

The method employs the concentrate burner 4, which further comprises a second gas supply device 18 for feeding second gas 16 into the reaction shaft 2, which comprises a second annular discharge opening 17, which is concentric with the first annular discharge opening 14 of the first gas supply device 12 of the concentrate burner and which opens in the reaction shaft 2 of the suspension smelting furnace.

The method comprises a stage, at which into the reaction shaft 2, fine solid matter 6 is fed into the reaction shaft 2 through the mouth 8 of the feeder pipe of the concentrate burner.

The method comprises a stage, at which diffusion gas 11 is fed into the reaction shaft 2 through the diffusion gas openings 10 of the diffusion device 9 of the concentrate burner for directing diffusion gas 11 to fine solid matter 6 that flows around the diffusion device 9.

The method comprises a stage, at which first gas 5 is fed into the reaction shaft 2 through the first annular discharge opening 14 of the first gas supply device 12 of the concentrate burner for mixing first gas 5 with fine solid matter 6, which discharges from the mouth 8 of the feeder pipe 7 in the middle and which is directed sidewards by means of diffusion gas 11.

The method comprises a stage, at which second gas 16 is fed into the reaction shaft 2 through the second annular discharge opening 17 of the second gas supply device 18. The method may comprise a stage, at which concentrate particles 22 are added to second gas 16 before feeding second gas 16 through the second annular discharge opening 17 of the second gas supply device 18.

The method may comprise a stage, at which liquid cooling agent 25 is added to first gas 5 by spraying before feeding first gas 5 into the reaction shaft 2 through the first annular discharge opening 14 of the first gas supply device 12.

The method may comprise a stage, at which liquid cooling agent 25 is added to second gas 16 by spraying before feeding second gas 16 into the reaction shaft 2 through the second annular discharge opening 17 of the second gas supply device 18.

The method may comprise a stage, at which first gas 5 is caused to spin before feeding first gas 5 through the first annular discharge opening 14 of the first gas supply device 12.

The method may comprise a stage, at which second gas 16 is caused to spin before feeding second gas 16 through the second annular discharge opening 17 of the second gas supply device 18.

In the method the first gas 5 and the second gas 16 may have different compositions.

In the method first gas supply device 12 is preferably, but not necessarily, supplied from a first source 28 and the second gas supply device 18 is preferably, but not necessarily, supplied from a second source 29 that is separated from the first source 28, as is shown in FIG. 8.

In the method a such concentrate burner 4 may be used that comprises a second gas supply device 18 having a second annular discharge opening 17 that is situated between the first annular discharge opening 14 and the mouth 8 of the feeder pipe, as is shown in FIG. 6.

In the method a such concentrate burner 4 may be used that comprises a second gas supply device 18 having a second annular discharge opening 17 that surrounds the first annular discharge opening 14, as is shown in FIGS. 2 to 6.

In the method a such concentrate burner 4 may be used that comprises a second gas supply device 18 where the second annular discharge opening 17 is situated inside the feeder pipe 7 of the fine solid matter supply device 27, as is shown in FIG. 7.

In the method a such concentrate burner 4 may be used that comprises a second gas supply device 18 where the second annular discharge opening 17 is situated inside the feeder pipe 7 of the fine solid matter supply device 27 and where the second annular discharge opening 17 surrounds the diffusion device 9 and is limited by the diffusion device 9, as is shown in FIG. 7.

Another object of the invention is the suspension smelting furnace 1, which comprises a reaction shaft 2, an uptake 3, a lower furnace 20 and a concentrate burner 4.

The concentrate burner 4 of the suspension smelting furnace comprises a fine solid matter supply device 27 which comprises a feeder pipe 7 for feeding fine solid matter 6 into the reaction shaft 2, where the mouth 8 of the feeder pipe opens in the reaction shaft 2. The fine solid matter can comprise, e.g., a nickel or copper concentrate, a slag formation agent and/or fly ash.

The concentrate burner 4 of the suspension smelting furnace further comprises a diffusion device 9, which is arranged concentrically inside the feeder pipe 7 and which extends to a distance from the mouth 8 of the feeder pipe inside the reaction shaft 2. The diffusion device 9 comprises diffusion gas openings 10 for directing diffusion gas 11 around the diffusion device 9 to fine solid matter 6 that flows around the diffusion device 9.

The concentrate burner 4 of the suspension smelting furnace further comprises a first gas supply device 12 for feeding first gas 5 into the reaction shaft 2. The first gas supply device 12 opens in the reaction shaft 2 through the first annular discharge opening 14, which surrounds the feeder pipe 7 concentrically, for mixing first gas 5 that discharges from the said first annular discharge opening 14 with fine solid matter 6, which discharges from the feeder pipe 7 in the middle and which is directed sidewards by means of diffusion gas 11.

The concentrate burner 4 of the suspension smelting furnace comprises further comprises a second gas supply device 18 for feeding second gas 16 into the reaction shaft 2. The second gas supply device 18 comprises a second annular discharge opening 17, which is concentric with the first annular discharge opening 14 of the first gas supply device 12 of the concentrate burner and which opens in the reaction shaft 2 of the suspension smelting furnace 1 for feeding second gas 16 into the reaction shaft 2. Another object of the invention is a concentrate burner 4 for feeding fine-grained solid matter 6 and gas into a reaction shaft 2 of a suspension smelting furnace 1.

The concentrate burner 4 comprises fine solid matter supply device 27 comprising a feeder pipe 7 for feeding fine-grained solid matter 6 into the reaction shaft 2.

The concentrate burner 4 comprises also a diffusion device 9, which is arranged concentrically inside the feeder pipe 7 and which extends to a distance from the mouth 8 of the feeder pipe, and which comprises diffusion gas holes 10 for directing diffusion gas 11 around the diffusion device 9 to fine solid matter 6 that flows around the diffusion device 9.

The concentrate burner 4 comprises also a first gas supply device 12 for feeding first gas 5 into the reaction shaft 2, the first gas supply device 12 opening through the first annular discharge opening 14 that concentrically surrounds the feeder pipe 7 for mixing first gas 5 that discharges from the said first annular discharge opening 14 with fine solid matter 6, which discharges from the feeder pipe 7 in the middle and which is directed sidewards by means of diffusion gas 11.

The concentrate burner 4 comprises also a second gas supply device 18 for feeding second gas 16 into the reaction shaft 2, the second gas supply device 18 comprising a second annular discharge opening 17, which is concentric with the first annular discharge opening 14 of the first gas supply device 12 of the concentrate burner for feeding second gas 16 into the reaction shaft 2.

The concentrate burner may comprise a feeding means 24 for concentrate particles for mixing concentrate particles with second gas 16 before feeding second gas 16 into the reaction shaft 2 through the second annular discharge opening 17 of the second gas supply device 18.

The concentrate burner may comprise a feeding arrangement 23 for liquid cooling agent for mixing liquid cooling agent 25 with first gas 5 by spraying before feeding first gas 5 into the reaction shaft 2 through the first annular discharge opening 14 of the first gas supply device 12.

The concentrate burner may comprise a feeding arrangement 23 for liquid cooling agent for mixing liquid cooling agent 25 with second gas 16 by spraying before feeding second gas 16 into the reaction shaft 2 through the second annular discharge opening 17 of the second gas supply device 18.

The concentrate burner may comprise a spinning means 19 for causing first gas 5 to spin before feeding first gas 5 into the reaction shaft 2 through the first annular discharge opening 14 of the first gas supply device 12.

The concentrate burner may comprise a spinning means 19 for causing second gas 16 to spin before feeding second gas 16 into the reaction shaft 2 through the second annular discharge opening 17 of the second gas supply device 18.

The concentrate burner may comprise first connection means 30 for connecting a first source 28 to the first gas supply device 12, and second connection means 31 for connecting a second source 29 to the second gas supply device 18, wherein the second source 29 is separated from the first source 28.

The concentrate burner may comprise a second gas supply device 18 having a second annular discharge opening 17 that is situated between the first annular discharge opening 14 and the mouth 8 of the feeder pipe, as is shown in FIG. 6.

The concentrate burner may comprise a second gas supply device 18 having a second annular discharge opening 17 that surrounds the first annular discharge opening 14, as is shown in FIGS. 2 to 5.

The concentrate burner may comprise a second gas supply device 18 having a second annular discharge opening 17 that is situated inside the feeder pipe 7 of the fine solid matter supply device 27, as is shown in FIG. 7.

The concentrate burner may comprise a second gas supply device 18 having a second annular discharge opening 17 that is situated inside the feeder pipe 7 of the fine solid matter supply device 27 such that the second annular discharge opening 17 surrounds the diffusion device 9 and is limited by the diffusion device 9, as is shown in FIG. 7.

The method and the suspension smelting furnace and the concentrate burner according to the invention can be used for solving process problems of different types of the suspension smelting furnace and/or for enhancing the suspension smelting process. In the following, seven different process problems and their solutions in the form of seven different embodiments are disclosed.

First Embodiment: Reducing the Generation of Nitrogen Oxides

The first embodiment of the method and the first embodiment of the suspension smelting furnace and the first embodiment of the concentrate burner relate to the reduction of nitrogen oxides that are generated in the suspension smelting process.

Nitrogen oxide or $NO_x$ emissions present a problem in all types of combustion processes, being problematic in flash smelting in that, when dissolving in the product acid at a sulphuric-acid plant, they cause a red mark in the paper, e.g., in paper bleaching. The main production mechanism for producing nitrogen oxide relates to combination of nitrogen and oxygen in a so-called thermic $NO_x$-reaction. When a concentrate particle is ignited, it may momentally reach a maximum temperature of over 2000° C. provided that enough oxygen is present and provided that the particle is not surrounded by cooling elements The first embodiment of the method employs technical oxygen ($O_2$) as the first gas 5 and the technical oxygen is fed into the reaction shaft 2 of the suspension smelting furnace 1 through the first annular discharge opening 14 of the first gas supply device 12 of the concentrate burner 4.

Correspondingly, in the first embodiment of the suspension smelting furnace, the first gas supply device 12 of the concentrate burner 4 is adapted to feed technical oxygen as the first gas 5 into the reaction shaft 2 of the suspension smelting furnace 1 through the first annular discharge opening 14.

Alternatively, the first embodiment of the method can employ air as the first gas 5, and feed air into the reaction shaft 2 of the suspension smelting furnace 1 through the first annular discharge opening 14 of the first gas supply device 12 of the concentrate burner 4.

Correspondingly, in this alternative of the first embodiment of the suspension smelting furnace and the concentrate burner, the first gas supply device 12 of the concentrate burner 4 is adapted to feed air as the first gas 5 into the reaction shaft 2 of the suspension smelting furnace 1 through the first annular discharge opening 14.

The first embodiment of the method, the suspension smelting furnace, and the concentrate burner is based on the fact that no nitrogen ($N_2$) is brought to the hottest fire area and, thus, the generation of nitrogen oxides or $NO_x$ is avoided, in this respect. In practice, this may mean that pure technical oxygen is fed through the inner discharge opening of the first gas supply device 12 of the concentrate burner 4, i.e., the first annular discharge opening 14, whereby no nitrogen is found in the hottest zone as regards the fuel gas. When the particle is ignited, its combustion temperature will no longer rise after ignition to a level high enough for the generation of thermal $NO_x$ to be very intense. In that case, oxygen can freely be brought through the outermost discharge opening 17 to complete the combustion or bring it to a desired level. Alternatively, the temperature of the combustion after the ignition can be controlled by using inert, thermal energy consuming gas such as nitrogen in air or by spraying liquid or solution (e.g., water, acid, ammonia) into the second gas.

The first embodiment of the method, the suspension smelting furnace, and the concentrate burner is based on the fact that the temperature of the hottest fire area is decreased; hence, the main $NO_x$ generation mechanism, the generation of so-called thermal $NO_x$ is avoided. In practice, this can mean, e.g., that pure technical oxygen is fed into the reaction shaft 2 of the suspension smelting furnace 1 through the first annular discharge opening 14 of the first gas supply device 12 of the concentrate burner 4, and that second gas 16 is fed into the reaction shaft 2 of the suspension smelting furnace 1 through the second annular discharge opening 17 of the second gas supply device 18 of the concentrate burner 4, which second gas can be air, oxygen-enriched air or oxygen, with which an endothermically decomposing liquid, i.e., a liquid that consumes heat energy when evaporating can be mixed. The second annular discharge opening 17 controls the maximum temperature, and the flame decreases. This first embodiment of the method and the suspension smelting also concerns the use of the method and the suspension smelting furnace for decreasing the generation of nitrogen oxides.

This first embodiment of the use of the method employs the method of reducing the generation of nitrogen oxides, so that technical oxygen is fed as first gas 5 into the reaction shaft 4 of the suspension smelting furnace 1 through the first annular discharge opening 14 of the first gas supply device 12 of the concentrate burner 4 of the suspension smelting furnace 1.

This first embodiment of the use of the method can alternatively employ the method of reducing the generation of nitrogen oxides, so that air is fed as first gas 5 into the reaction shaft 4 of the suspension smelting furnace 1 through the first annular discharge opening 14 of the first gas supply device 12 of the concentrate burner 4 of the suspension smelting furnace 1.

This first embodiment of the use of the suspension smelting furnace and the concentrate burner uses the suspension smelting furnace for reducing the generation of nitrogen oxides, so that the concentrate burner 4 of the suspension smelting furnace 1 is adapted to feed technical oxygen as first gas 5 into the reaction shaft 2 of the suspension smelting furnace 1 through the first annular discharge opening 14 of the first gas supply device 12.

This first embodiment of the use of the suspension smelting furnace and the concentrate burner can alternatively employ the suspension smelting furnace for reducing the generation of nitrogen oxides, so that the concentrate burner 4 of the suspension smelting furnace 1 is adapted to feed air as first gas 5 into the reaction shaft 2 of the suspension smelting furnace 1 through the first annular discharge opening 14 of the first gas supply device 12.

Second Embodiment: Improving the Ignition of the Concentrate

The second embodiment of the method, the second embodiment of the suspension smelting furnace, and second embodiment of the concentrate burner relate to the improvement of the ignition of the concentrate.

It is preferable for the flash smelting process, if concentrate, such as fine solid matter that is fed into the reaction shaft 2 of the suspension smelting furnace 1 warms up and is ignited as quickly as possible after reaching the level of the diffusion gas openings 10 of the diffusion device 9 of the concentrate burner 4.

The first embodiment of the method employs technical oxygen as first gas 5, and technical oxygen is fed into the reaction shaft 2 of the suspension smelting furnace 1 through the first annular discharge opening 14 of the first gas supply device 12 of the concentrate burner 4.

Correspondingly, in the second embodiment of the suspension smelting furnace 1 and the concentrate burner, the first gas supply 12 of the concentrate burner 4 is adapted to feed technical oxygen as first gas 5 into the reaction shaft 2 of the suspension smelting furnace 1 through the first annular discharge opening 14.

This second embodiment of the method and the suspension smelting furnace also concerns the use of the method, the suspension smelting furnace and the concentrate burner for improving the ignition of the concentrate in the reaction shaft 2. The method and the suspension smelting furnace can be used for improving the ignition of the concentrate in the reaction shaft 2 by feeding technical oxygen as first gas 5 through the first annular discharge opening 15.

In the second embodiment of the method, the suspension smelting furnace and the concentrate burner, the oxygen potential (portion of oxygen in the prevailing gas) is increased in the vicinity of the mouth 8 of the feeder pipe 7 of the concentrate burner 4 for oxygen to diffuse more effectively into the pores of concentrate particles. In practice, this means that pure technical oxygen is fed through the first annular discharge opening 14 of the first gas supply device 12 of the concentrate burner 4 into the reaction shaft 4 of the suspension smelting furnace 1, enabling an earlier ignition.

The second embodiment of the method, the suspension smelting furnace and the concentrate burner is based on the fact that pure technical oxygen is fed through the first annular discharge opening 14 by using an advantageous way in terms of flow formation (e.g., a turbulence) to make fine solid matter 6 effectively mix with oxygen and ignite quickly. However, all oxygen needed for the combustion is not necessarily fed through the first annular opening 14, but only that which is needed for an effective ignition, whereby the rest of the oxygen needed for the burning can be run through the second annular discharge opening 17.

Third Embodiment: Feeding Particles of Different Sizes into the Suspension Smelting Furnace The third embodiment of the method, the third embodiment of the suspension smelting furnace, and the third embodiment of the concentrate burner relate to feeding different-size particles into the reaction shaft of the suspension smelting furnace.

Current concentrate burners perform relatively well in mixing concentrate particles and oxygen into a smooth homogeneous mixture, but the requirements of combustion between the different particle sizes of the concentrate particles are not taken into account. Therefore, the smallest particles oxidize more and the larger ones less; hence, the control of the end result is handled with respect to the overall end result, i.e., the slag chemistry.

In the third embodiment of the method, concentrate particles are added to second gas 16 before feeding second gas 16 into the reaction shaft 2 of the suspension smelting furnace 1 through the second annular discharge opening 17 of the second gas supply device 18. In this third embodiment of the method a screen 21 may be used for dividing the concentrate into a fraction comprising small concentrate particles and a fraction comprising large concentrate particles.

The third embodiment of the suspension smelting furnace and the concentrate burner comprises a feeding member 24 of concentrate particles for mixing concentrate particles with second gas 16 before feeding second gas 16 into the reaction shaft 2 of the suspension smelting furnace 1 through the second annular discharge opening 17 of the second gas supply device 18.

Figure 3:
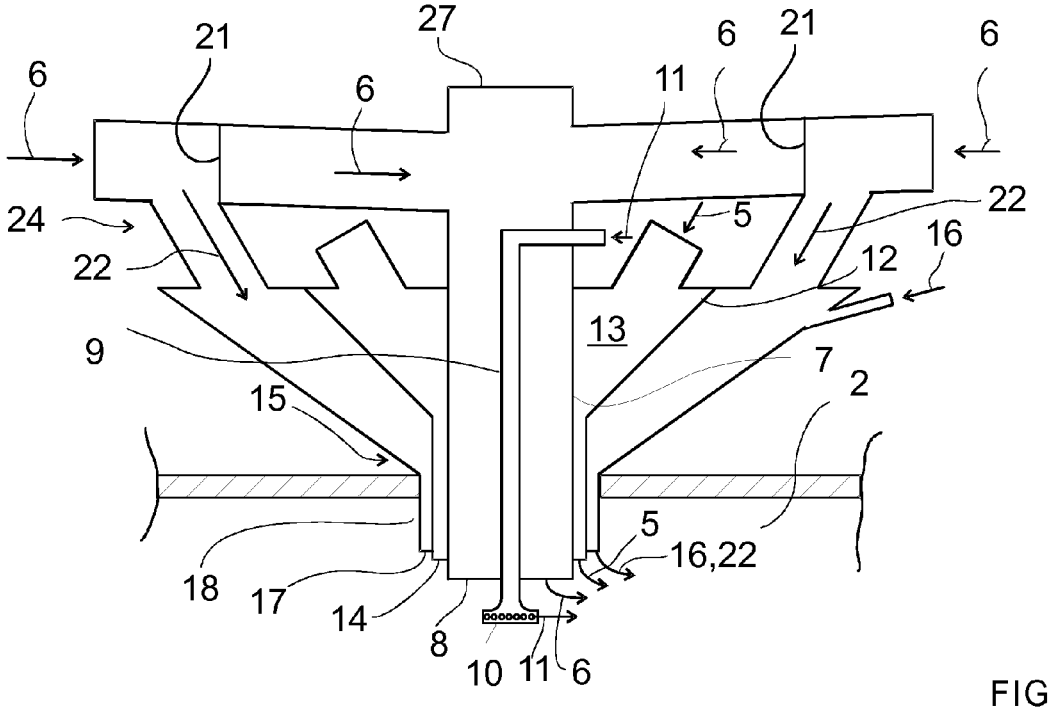
FIG. 3 shows a second concentrate burner, which can be used in the third embodiment of the method and the suspension smelting furnace according to the invention.
Figure 4:
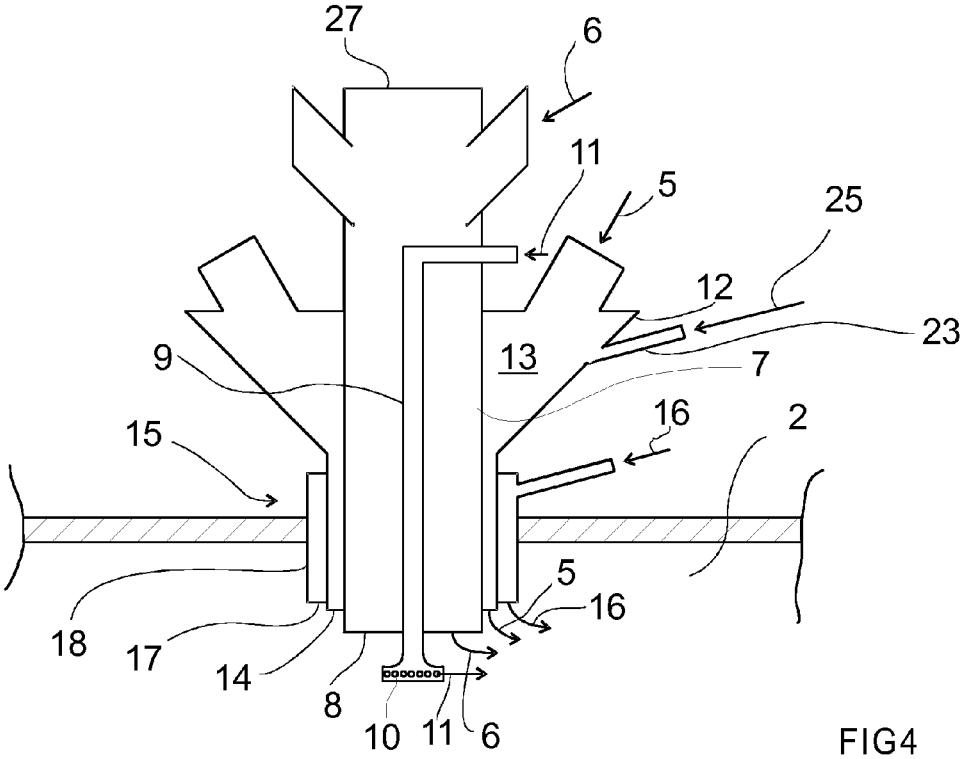
FIG. 4 shows a third concentrate burner, which can be used in the fourth embodiment of the method and the suspension smelting furnace according to the invention.

Before feeding into the suspension smelting furnace 1, fine solid matter should typically be dried of any excess humidity by running it through a so-called drier (not shown in the figures). Typically, after such a drier, there is a screen (not shown), which divides the flow of fine solid matter into two parts: a finer fraction that penetrates the screen, i.e., penetrated matter, and a substance that does not penetrate the screen, i.e., nonpenetrated matter. In this third embodiment of the solution, this nonpenetrated matter can be screened again by a screen 21 that has a larger screen mesh, and by means of penetrated matter, two concentrate flows having different size distributions are provided: a fine fraction and a coarse fraction. The fine fraction is run as a feed material 6 from the concentrate burner and coarse fraction 22 is mixed with second gas 16 and fed through an outer gas channel 17. Thus, the degree of oxidation of the particles can be better controlled comprehensively. Such a solution is shown in FIG. 3.

This third embodiment of the method, the suspension smelting furnace and the concentrate burner also concerns the use of the method and the suspension smelting furnace for feeding first concentrate particle fraction and second concentrate particle fraction into the reaction shaft 2 of the suspension smelting furnace 1, whereby the first concentrate particle fraction contains smaller concentrate particles than the second concentrate particle fraction. This third embodiment employs the suspension smelting furnace so that first concentrate particle fraction is fed into the reaction shaft 2 through the mouth 8 of the feeder pipe 7, and second concentrate particle fraction, mixed with second gas 16, is fed into the reaction shaft 2 through the second annular discharge opening 17 of the second gas supply device 18.

Since the concentrate burner comprises the first annular discharge opening and the second annular discharge opening, different feeding speeds and oxygen enrichments can be used and thus balance the differences of the degree of oxidation of the concentrate particles.

Fourth Embodiment: Controlling the Temperature of the Reaction Shaft of the Suspension Smelting Furnace The fourth embodiment of the method, the fourth embodiment of the suspension smelting furnace and the fourth embodiment of the concentrate burner relate to controlling the temperature of the reaction shaft of the suspension smelting furnace.

In the fourth embodiment of the method, liquid cooling agent 25 is added to first gas 5 by spraying before feeding first gas 5 into the reaction shaft 2 of the suspension smelting furnace 1 through the first annular discharge opening 14 of the first gas supply device 12. Alternatively or additionally, in this fourth embodiment of the method, liquid cooling agent 25 can be added to second gas 16 by spraying before feeding second gas 16 through the second annular discharge opening 17 of the second gas supply device 18.

In the fourth embodiment of the suspension smelting furnace 1 and the concentrate burner, the concentrate burner 4 comprises a feeding arrangement 23 for liquid cooling agent for mixing liquid cooling agent 25 with first gas 5 by spraying before feeding first gas 5 into the reaction shaft 2 of the suspension smelting furnace 1 through the first annular discharge opening 14 of the first gas supply device 12. Alternatively or additionally, in this fourth embodiment of the suspension smelting furnace 1, the concentrate burner 4 can comprise the feeding arrangement 23 for liquid cooling agent for mixing liquid cooling agent 25 with second gas 16 by spraying before feeding second gas 16 into the reaction shaft 2 of the suspension smelting furnace 1 through the second annular discharge opening 17 of the second gas supply device 18. Such a concentrate burner 4 is shown in FIG. 3.

In this fourth embodiment of the method, the suspension smelting furnace and the concentrate burner, the amount of liquid cooling agent 25 that is sprayed to first gas 5 can be used to control as to how much heat energy is taken by liquid cooling agent 25, when evaporating and/or possibly diffusing, from the actual suspension smelting process.

This fourth embodiment of the method, the suspension smelting furnace and the concentrate burner also concerns the use of the method and the suspension smelting furnace for controlling the temperature of the reaction shaft of the suspension smelting furnace.

This fourth embodiment of the use of the method employs the suspension smelting furnace so that liquid cooling agent 25 is fed by spraying into the reaction shaft of the suspension smelting furnace through the second annular discharge opening.

This fourth embodiment of the use of the suspension smelting furnace and the concentrate burner employs the suspension smelting furnace so that liquid cooling agent 25 is fed by spraying into the reaction shaft of the suspension smelting furnace through the second annular discharge opening.

The fourth embodiment of the method, the suspension smelting furnace and the concentrate burner also employs the concentrate burner for cooling the reaction shaft, which is an entirely novel idea compared with a conventional model. In other words, in the fourth embodiment of the method and the suspension smelting furnace, liquid cooling agent 25, which is an endothermal substance in liquid form, is fed into the reaction shaft of the suspension smelting furnace through the concentrate burner. The liquid cooling agent 25 may comprise, e.g., at least one of the following: water, acid, such as weak or strong sulphuric acid and different metallic salt solutions, such as a copper sulphate solution.

Fifth Embodiment: Prevention of the Generation of Residual Oxygen

The fifth embodiment of the method, the fifth embodiment of the suspension smelting furnace, and the fifth embodiment of the concentrate burner, concern the prevention of the generation of residual oxygen.

Excess oxygen, i.e., so-called residual oxygen in the front part of the boiler causes, in a specific temperature range, the oxidation of $SO_2$ into $SO_3$, which in an acid plant is washed, turning into undesired wash acid.

In the fifth embodiment of the method, first gas 5 is made to spin before feeding first gas 5 into the reaction shaft 2 of the suspension smelting furnace 1 through the first annular discharge opening 14 of the first gas supply device 12.

In the fifth embodiment of the suspension smelting furnace and the concentrate burner, the concentrate burner comprises a spinning means 19 for making first gas 5 spin before feeding first gas 5 into the reaction shaft 2 of the suspension smelting furnace 1 through the first annular discharge opening 14 of the first gas supply device 12. Such a concentrate burner 4 is shown in FIG. 5.

In the fifth embodiment of the suspension smelting furnace and the concentrate burner, the concentrate burner 4 comprises preferably, but not necessarily, a pipe 26, which is adjustable in the vertical direction and which makes it possible to premix first gas 5 with the concentrate particles before feeding it into the reaction shaft 2 of the suspension smelting furnace 1. Such a concentrate burner 4 is shown in FIG. 5.

In the fifth embodiment of the method, alternatively or additionally, second gas 16 can be made spin before feeding second gas 16 into the reaction shaft 2 of the suspension smelting furnace 1 through the second annular discharge opening 17 of the second gas supply device 18.

Correspondingly, in the fifth embodiment of the suspension smelting furnace and the concentrate burner, the concentrate burner can comprise a spinning means for making second gas 16 spin before feeding the second gas 16 into the reaction shaft 2 of the suspension smelting furnace 1 through the second annular discharge opening 17 of the second gas supply device 18.

This fifth embodiment of the method, the suspension smelting furnace and the concentrate burner also concerns the use of the method and the suspension smelting furnace for reducing the residual oxygen in the reaction shaft 2 of the suspension smelting furnace.

In this fifth embodiment of the use of the method, the suspension smelting furnace is used so that first gas is caused to spin before feeding first gas 5 into the reaction shaft 2 of the suspension smelting furnace 1 through the first annular discharge opening 14 of the first gas supply device 12.

In this fifth embodiment of the use of the suspension smelting furnace and the concentrate burner, the suspension smelting furnace is used so that first gas is caused to spin before feeding first gas 5 into the reaction shaft 2 of the suspension smelting furnace 1 through the first annular discharge opening 14 of the first gas supply device 12.

The fifth embodiment of the method, the suspension smelting furnace and the concentrate burner is based on the fact that the mixing of concentrate with oxygen is enhanced by causing first gas 5, which comes through the inner discharge opening, i.e., the first annular discharge opening 14 of the first gas supply device 12 of the concentrate burner 4, to spin. The turbulence thus generated increases the dwell time of the concentrate particles in the shaft and enhances their mixing with oxygen. These factors together result in particles more effectively consuming oxygen fed that is to them.

Sixth Embodiment: Reduction of the Amount of Fly Ash and Burner Outgrowth

The sixth embodiment of the method and the sixth embodiment of the suspension smelting furnace, and the sixth embodiment of the concentrate burner concern the reduction of the amount of fly ash and burner outgrowth.

In the sixth embodiment of the method, second gas 16 is fed into the reaction shaft 2 of the suspension smelting furnace 1 through the second annular discharge opening 17 of the second gas supply device 18 at a flow velocity of 10-200 m/s. In the sixth embodiment of the suspension smelting furnace, the concentrate burner 4 of the suspension smelting furnace 1 comprises a means of feeding second gas 16 into the reaction shaft 2 of the suspension smelting furnace 1 through the second annular discharge opening 17 of the second gas supply device 18 at a velocity of 10-200 m/s. A low velocity of 10-50 m/s is used in trying to prevent the access of return flows to the vicinity of the concentrate burner 4, whereby the return flow dust brought along by them cannot adhere to the vicinity of the concentrate burner 4. A higher velocity of 50-200 m/s, again, prevents the dust from being swept away from the suspension, in general, as described above.

This sixth embodiment of the method, the suspension smelting furnace and the concentrate burner also concerns the use of the method and the suspension smelting furnace for reducing the amount of fly ash and burner outgrowth in the reaction shaft of the suspension smelting furnace.

In this sixth embodiment of the use of the method, second gas 16 is fed into the reaction shaft 2 of the suspension smelting furnace 1 through the second annular discharge opening 17 of the second gas supply device 18 at a velocity of 10-200 m/s.

In this sixth embodiment of the use of the suspension smelting furnace and the concentrate burner, the concentrate burner 4 is adapted to feed second gas 16 into the reaction shaft 2 of the suspension smelting furnace 1 through the second annular discharge opening 17 of the second gas supply device 18 at a velocity of 10-200 m/s.

In other words, in the sixth embodiment of the method, the suspension smelting furnace and the concentrate burner, gas is run through the outer discharge opening at a flow velocity fast enough to prevent particles from being swept away in the form of so-called fly ash into the exhaust gas flow in the middle of the suspension. At the same time, the return of these particles, which are swept away, back to the concentrate burner 4 in the return flow, is prevented and, thus, the generation of outgrowth in the concentrate burner 4 or its immediate vicinity is prevented.

Seventh Embodiment: Enhancing the Mixing of Oxygen and Fine-Grained Solid Matter The seventh embodiment of the method, the seventh embodiment of the suspension smelting furnace, and the seventh embodiment of the concentrate burner concern enhancing mixing of oxygen and fine-grained solid matter In the seventh embodiment of the method a such concentrate burner 4 is used that comprises a second gas supply device 18 having a second annular discharge opening 17 that is situated inside the feeder pipe 7 of the fine solid matter supply device 27 and oxygen, technical oxygen, or oxygen enriched air is used as second gas 16.

In the seventh embodiment of the method is preferably a such concentrate burner 4 is used that comprises a second gas supply device 18 having a second annular discharge opening 17 that is situated inside the feeder pipe 7 of the fine solid matter supply device 27 and where the second annular discharge opening 17 surrounds the diffusion device 9 and is limited by the diffusion device 9 and oxygen, technical oxygen, or oxygen enriched air is used as second gas 16. A such concentrate burner 4 is shown in FIG. 7.

In the seventh embodiment of the suspension smelting furnace and of the concentrate burner the concentrate burner 4 comprising a second gas supply device 18 having a second annular discharge opening 17 that is situated inside the feeder pipe 7 of the fine solid matter supply device 27. In this seventh embodiment the second annular discharge opening 17 is preferably, but not necessarily, surrounding the diffusion device 9 and is limited by the diffusion device 9.

By feeding trough the second annular discharge opening 17 oxygen or oxygen enriched air as second gas 16, oxygen is made to mix with fine-grained solid matter 6 already before oxygen and fine-grained solid matter 6 is fed into the reaction shaft, resulting in that the ignition occurs rapidly.

By this seventh embodiment is also a more stable flame achieved, which is a result of the good mixing of oxygen and fine-grained solid matter.

Another advantage that is achieved with this seventh embodiment is that in suspension smelting processed there is normally a shortage of oxygen in the middle of the reaction shaft 2, and by placing a second gas supply device 18 having a second annular discharge opening 17 that is situated inside the feeder pipe 7 of the fine solid matter supply device 27 as suggested in this seventh embodiment and by feeding oxygen or oxygen enriched air through this second annular discharge opening 17, can the amount of oxygen in the middle of the reaction shaft 2 be raised.

It is obvious to those skilled in the art that with the technology improving, the basic idea of the invention can be implemented in various ways. The invention and its embodiments are thus not limited to the examples described above, but they may vary within the claims.

The invention claimed is:

1. A suspension smelting furnace comprising a reaction shaft, an uptake, a lower furnace and a concentrate burner;

whereby the concentrate burner comprises fine solid matter supply device comprising a feeder pipe for feeding fine-grained solid matter into the reaction shaft, wherein a mouth of the feeder pipe opens in the reaction shaft, a diffusion device, which is arranged concentrically inside the feeder pipe and which extends to a distance from the mouth of the feeder pipe inside the reaction shaft, and which comprises diffusion gas holes for directing diffusion gas around the diffusion device to fine solid matter that flows around the diffusion device; and a first gas supply device for feeding a first gas into the reaction shaft, the first gas supply device opening in the reaction shaft through a first annular discharge opening that concentrically surrounds the feeder pipe for mixing first gas that discharges from said first annular discharge opening with fine solid matter which discharges from the feeder pipe in the middle and which is directed sidewards by means of diffusion gas;

wherein the concentrate burner comprises a second gas supply device for feeding second gas into the reaction shaft, the second gas supply device comprising a second annular discharge opening, which is concentric with the first annular discharge opening of the first gas supply device of the concentrate burner and which opens in the reaction shaft of the suspension smelting furnace for feeding second gas into the reaction shaft, comprising a first source for supplying the first gas supply device, and comprising second source for supplying the second gas supply device, wherein the second source is separated from the first source.

2. A suspension smelting furnace according to claim 1, wherein the first gas supply device is adapted to feed technical oxygen as first gas through the first annular discharge opening.

3. A suspension smelting furnace according to claim 1, wherein the first gas supply device is adapted to feed air as first gas through the first annular discharge opening.

4. A suspension smelting furnace according to claim 1, comprising a feeder for concentrate particles for mixing concentrate particles with second gas before feeding second gas through the second annular discharge opening of the second gas supply device into the reaction shaft.

5. A suspension smelting furnace according to claim 1, comprising a feeding arrangement for liquid cooling agent for mixing liquid cooling agent with first gas by spraying before feeding first gas through the first annular discharge opening of the first gas supply device into the reaction shaft.

6. A suspension smelting furnace according to claim 1, comprising a feeding arrangement for liquid cooling agent for mixing liquid cooling agent with second gas by spraying before feeding second gas through the second annular discharge opening of the second gas supply device into the reaction shaft.

7. A suspension smelting furnace according to claim 1, comprising a spinner for causing first gas to spin before feeding first gas through the first annular discharge opening of the first gas supply device into the reaction shaft.

8. A suspension smelting furnace according to claim 1, comprising a spinner for causing second gas to spin before feeding second gas through the second annular discharge opening of the second gas supply device into the reaction shaft.

9. A suspension smelting furnace according to claim 1, comprising a feeder for feeding second gas through the second annular discharge opening of the second gas supply device at a velocity of 10-200 m/s into the reaction shaft.

10. The suspension smelting furnace according to claim 1, wherein the concentrate burner comprises a second gas supply device having a second annular discharge opening that is situated inside the feeder pipe of the fine solid matter supply device.

11. The suspension smelting furnace according to claim 10 wherein the second annular discharge opening surrounds the diffusion device and is limited by the diffusion device.

12. A concentrate burner for feeding fine-grained solid matter and gas into a reaction shaft of a suspension smelting furnace, whereby the concentrate burner comprises fine solid matter supply device comprising a feeder pipe for feeding fine-grained solid matter into the reaction shaft, a diffusion device, which is arranged concentrically inside the feeder pipe and which extends to a distance from a mouth of the feeder pipe, and which comprises diffusion gas holes for directing diffusion gas around the diffusion device to fine solid matter that flows around the diffusion device; and a first gas supply device for feeding first gas into the reaction shaft, the first gas supply device opening through a first annular discharge opening that concentrically surrounds the feeder pipe for mixing first gas that discharges from said first annular discharge opening with fine solid matter which discharges from the feeder pipe in the middle and which is directed sidewards by means of diffusion gas;

wherein the concentrate burner comprises a second gas supply device for feeding second gas into the reaction shaft, the second gas supply device comprising a second annular discharge opening, which is concentric with the first annular discharge opening of the first gas supply device of the concentrate burner for feeding second gas into the reaction shaft, comprising first connector for connecting a first source to the first gas supply device, and comprising second connector for connecting a second source to the second gas supply device, wherein the second source is separated from the first source.

13. The concentrate burner according to claim 12, wherein the first gas supply device is adapted to feed technical oxygen as first gas through the first annular discharge opening.

14. The concentrate burner according to claim 12, wherein the first gas supply device is adapted to feed air as first gas through the first annular discharge opening.

15. The concentrate burner according to claim 12, comprising a feeder for concentrate particles for mixing concentrate particles with second gas before feeding second gas through the second annular discharge opening of the second gas supply device.

16. The concentrate burner according to claim 12, comprising a feeding arrangement for liquid cooling agent for mixing liquid cooling agent with first gas by spraying before feeding first gas through the first annular discharge opening of the first gas supply device.

17. The concentrate burner according to claim 12, comprising a feeding arrangement for liquid cooling agent for mixing liquid cooling agent with second gas by spraying before feeding second gas through the second annular discharge opening of the second gas supply device.

18. The concentrate burner according to claim 12, comprising a spinner for causing first gas to spin before feeding first gas through the first annular discharge opening of the first gas supply device.

19. The concentrate burner according to claim 12, comprising a spinner for causing second gas to spin before feeding second gas through the second annular discharge opening of the second gas supply device.

20. The concentrate burner according to claim 12, comprising a feeder for feeding second gas through the second annular discharge opening of the second gas supply device at a velocity of 10-200 m/s.

21. The concentrate burner according to claim 12, wherein the concentrate burner a second gas supply device having a second annular discharge opening that is situated inside the feeder pipe of the fine solid matter supply device.

22. The concentrate burner according to claim 12, wherein the second annular discharge opening surrounds the diffusion device and is limited by the diffusion device.

* * * * *